US006977636B2

(12) United States Patent
Jinda et al.

(10) Patent No.: US 6,977,636 B2
(45) Date of Patent: Dec. 20, 2005

(54) LIQUID CRYSTAL DISPLAY DEVICE DRIVING METHOD

(75) Inventors: Akihito Jinda, Kitakatsuragi-gun (JP); Koichi Miyachi, Souraku-gun (JP); Hidekazu Miyata, Nagoya (JP)

(73) Assignee: Sharp Kabushiki Kaisha, Osaka (JP)

( * ) Notice: Subject to any disclaimer, the term of this patent is extended or adjusted under 35 U.S.C. 154(b) by 299 days.

(21) Appl. No.: 09/922,183

(22) Filed: Aug. 2, 2001

(65) Prior Publication Data

US 2002/0044115 A1 Apr. 18, 2002

(30) Foreign Application Priority Data

Aug. 3, 2000 (JP) ..... 2000-235633
Jun. 11, 2001 (JP) ..... 2001-175453

(51) Int. Cl.[7] ..... G09G 3/36
(52) U.S. Cl. ..... 345/94; 345/87; 345/204; 345/690
(58) Field of Search ..... 345/87–89, 204, 345/545, 690, 691, 94, 95, 98, 99, 210

(56) References Cited

U.S. PATENT DOCUMENTS 5,347,294 A * 9/1994 Usui et al. ..... 345/89
5,920,300 A * 7/1999 Yamazaki et al. ..... 345/94
6,366,065 B1 * 4/2002 Morita ..... 323/280
6,452,579 B1 * 9/2002 Itoh et al. ..... 345/100
6,791,525 B2 * 9/2004 Matsumura et al. ..... 345/100
2001/0038369 A1 * 11/2001 Adachi et al. ..... 345/87

FOREIGN PATENT DOCUMENTS

| | | |
|---|---|---|
| JP | 3-174186 | 7/1991 |
| JP | 06-062355 | 3/1994 |
| JP | A-08500915 | 1/1996 |
| WO | WO95/01701 | 1/1995 |

* cited by examiner

*Primary Examiner*—Ricardo Osorio
*Assistant Examiner*—Tom Sheng
(74) *Attorney, Agent, or Firm*—Harness, Dickey & Pierce, P.L.C.

(57) ABSTRACT

While image data is written into either one of first, second, third frame memories 1, 2 and 3, image data are repetitively read two times from the remaining two memories in one vertical synchronization interval and transferred to an arithmetic unit 4, and this operation is executed with the frame memories changed sequentially. An arithmetic unit 4 refers to a look-up table on the basis of two inputted data values and, when the data value of the current image signal is greater than the data value of the previous image signal, the unit 4 transfers image data of a value greater than the data value of the current image signal to a liquid crystal display device 5. Thus, the step response characteristic is improved for the improvement of the dynamic image display quality.

59 Claims, 7 Drawing Sheets

| | | DATA VALUE OF PREVIOUS IMAGE SIGNAL | | | | | |
|---|---|---|---|---|---|---|---|
| | | 10 | 20 | 30 | 40 | 50 | 60 |
| DATA VALUE OF CURRENT IMAGE SIGNAL | 10 | 10 | 8 | 6 | 4 | 2 | 0 |
| | 20 | 22 | 20 | 18 | 16 | 14 | 12 |
| | 30 | 34 | 32 | 30 | 28 | 26 | 24 |
| | 40 | 46 | 44 | 42 | 40 | 38 | 36 |
| | 50 | 58 | 56 | 54 | 52 | 50 | 48 |
| | 60 | 70 | 68 | 66 | 64 | 62 | 60 |

LIQUID CRYSTAL DISPLAY DEVICE DRIVING METHOD

BACKGROUND OF THE INVENTION

The present invention relates to a liquid crystal display device driving method for improving the display quality of dynamic images (moving images).

In recent years, the liquid crystal display that employs a matrix type liquid crystal display device has a spreading market in a variety of commercial fields as a display device for a television set inclusive of OA (Office Automation) equipment taking advantage of its features of a thin configuration, light weight and low consumption of power. According to this trend, the liquid crystal display is used for displaying not only characters and pictures but also dynamic images such as images based on a television signal and a video signal. However, in the present circumstances, the liquid crystal display cannot obtain vivid images in displaying dynamic images in comparison with the CRT (Cathode Ray Tube) type display. The liquid crystals employed in the liquid crystal display have a slower response speed with regard to its transmittance to the applied voltage and a poor charge characteristic in compliance with the change in permittivity of the liquid crystals and are accordingly unable to sufficiently respond to rapid changes in the image signal.

In order to improve the aforementioned drawbacks with regard to the dynamic image display, National Publication of the Translation No. No. HEI 8-500915 turns on the backlight illumination for displaying the image written in the liquid crystal display device only in a part of time for display and is provided with a dark period with the backlight illumination turned off in the remaining part of time. By so doing, the image is visually perceived as if it moved smoothly, improving the dynamic image display.

The transmittance of liquid crystals changes as a consequence of the change in the orientation of liquid crystal molecules due to the written (applied) voltage. However, the permittivity also changes when the orientation of the liquid crystal molecules change, and the value of the applied voltage accordingly changes due to the change in the permittivity. Therefore, in order to obtain a specified transmittance, it is required to repetitively supply the voltage during several vertical synchronization intervals, and the liquid crystals are to have a step response characteristic. As a method for improving the reduction in the response speed of liquid crystals due to this step response characteristic, Japanese Patent Laid-Open Publication No. HEI 6-62355 discloses the improvement in the step response characteristic of liquid crystals by superimposing a difference component by comparison with the previous image signal.

However, the aforementioned conventional method for improving the drawback of dynamic image display has the problems as follows. That is, in the case of National Publication of the Translation No. HEI 8-500915 in which the backlight illumination is turned on only in a part of time, there is a problem that the image becomes dark as a consequence of the reduction in illuminance of the liquid crystal display device due to the occurrence of a period during which the backlight is turned off. Moreover, there is another problem that the image signal of the previous frame is visually superimposed since the response speed of the liquid crystals is not improved, resulting in a double or triple vision.

In the case of Japanese Patent Laid-Open Publication No. HEI 6-62355 in which the component of difference with respect to the previous image signal is superimposed in repetitively supplying the voltage during several vertical synchronization intervals, the response characteristic of the liquid crystals is utterly insufficient for display within one vertical synchronization interval. Even if the illumination is darkened during a part of the period as in the case of, for example, Japanese Patent Publication No. HEI 8-500915, there is a problem that the period during which the change in the liquid crystals is insufficient is disadvantageously displayed. Moreover, it is required to increase the value of the voltage to be superimposed in order to make the liquid crystals have a rapid response, in this case the transmittance becomes larger than the intended transmittance. Accordingly, there arises the need for restoring the transmittance in the next one vertical synchronization interval, and this consequently leads to a reverse step response, causing a problem that the response characteristic is not improved.

SUMMARY OF THE INVENTION

Accordingly, the object of the present invention is to provide a liquid crystal display device driving method capable of improving the response characteristic of liquid crystals and further improving the display quality of dynamic images.

In order to achieve the above object, there is provided a liquid crystal display device driving method for driving a liquid crystal display device by supplying image data to be written into each pixel of the liquid crystal display device to the liquid crystal display device a plurality of times in one vertical synchronization interval, comprising the step of:

obtaining the whole image data supplied the plurality of times in one vertical synchronization interval on the basis of a data value of an image signal in a previous vertical synchronization interval and a data value of an image signal in a current vertical synchronization interval.

According to the above-mentioned construction, the image data obtained on the basis of the data value of the image signal in the previous vertical synchronization interval and the data value of the image signal in the current vertical synchronization interval is supplied the plurality of times within one vertical synchronization interval and written into each pixel. Therefore, for example, when the data value of the current image signal is greater than the data value of the previous image signal, by supplying image data of a value greater than the data value of the current image signal to the liquid crystal display device, the response characteristic of the light transmittance of the liquid crystals is improved in comparison with the case where the image data of the value identical to the data value of the current image signal is supplied repetitively a plurality of times once per vertical synchronization interval. Moreover, the rise of the light transmittance of the liquid crystals is improved in comparison with the case where the image data of the value greater than the data value of the current image signal is supplied only once per vertical synchronization interval.

Also, there is provided a liquid crystal display device driving method for driving a liquid crystal display device by supplying image data to be written into each pixel of the liquid crystal display device to the liquid crystal display device a plurality of times in one vertical synchronization interval, comprising the step of:

obtaining image data supplied at least at a first time out of the image data supplied the plurality of times in one vertical synchronization interval on the basis of a data value of an image signal in a previous vertical synchronization interval and a data value of an image signal in a current vertical synchronization interval.

According to the above-mentioned construction, the image data supplied at least at a first time out of the image data supplied the plurality of times in one vertical synchronization interval to the liquid crystal display device is obtained on the basis of the data value of the image signal in the previous vertical synchronization interval and the data value of the image signal in the current vertical synchronization interval. Therefore, for example, when the data value of the current image signal is greater than the data value of the previous image signal, by supplying image data of a value greater than the data value of the current image signal at a first time, the response characteristic of the light transmittance of the liquid crystals is improved in comparison with the case where the image data of the value identical to the data value of the current image signal is supplied repetitively a plurality of times in one vertical synchronization interval or in the case where the image data of the value greater than the data value of the current image signal is supplied only once per vertical synchronization interval.

In one embodiment of the present invention, the image data supplied at second and subsequent times out of the image data supplied the plurality of times in one vertical synchronization interval is provided by image data that has a value identical to the data value of the image signal in the vertical synchronization interval.

According to the embodiment, the image data supplied at second and subsequent times out of the image data supplied the plurality of times in one vertical synchronization interval is provided by image data that has a value identical to the data value of the image signal in the vertical synchronization interval. Therefore, by appropriately setting the image data supplied at a first time, the time for the attainment of the target light transmittance of the liquid crystals is shortened. Therefore, the dynamic image display quality is further improved.

In one embodiment of the present invention, at least one piece of image data out of the image data supplied at second and subsequent times out of the image data supplied the plurality of times in one vertical synchronization interval is provided by image data that has a specified value intermediate between the data value of the image signal in the previous vertical synchronization interval and the data value of the image signal in the current vertical synchronization interval.

According to the embodiment, at least one piece of image data out of the image data supplied at second and subsequent times out of the image data supplied the plurality of times in one vertical synchronization interval is provided by image data that has a specified value intermediate between the data value of the image signal in the previous vertical synchronization interval and the data value of the image signal in the current vertical synchronization interval. Therefore, by appropriately setting the image data supplied at a first time and the image data supplied at second and subsequent times, the rise of the light transmittance of the liquid crystals is improved, and the target light transmittance is attained within one vertical synchronization interval. Furthermore, the quantity of light integrated timewise is perceived equal to the quantity of light with the target light transmittance in one vertical synchronization interval, and therefore, the light transmittance is improved.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
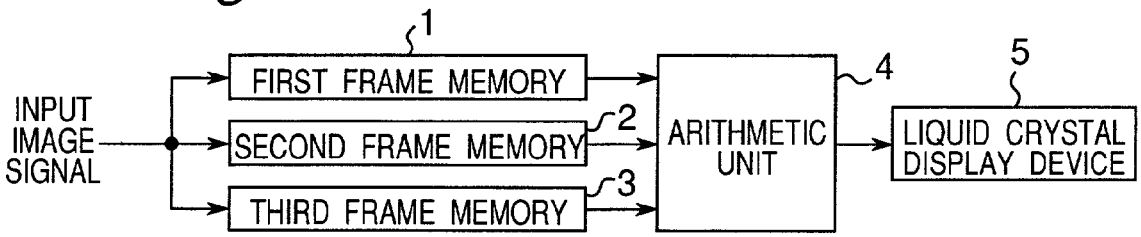
FIG. 1 is a block diagram of a drive circuit for materializing the liquid crystal display device driving method of the present invention.

The present invention will be described in detail below on the basis of the embodiments thereof shown in the drawings.

First Embodiment

Figure 2:
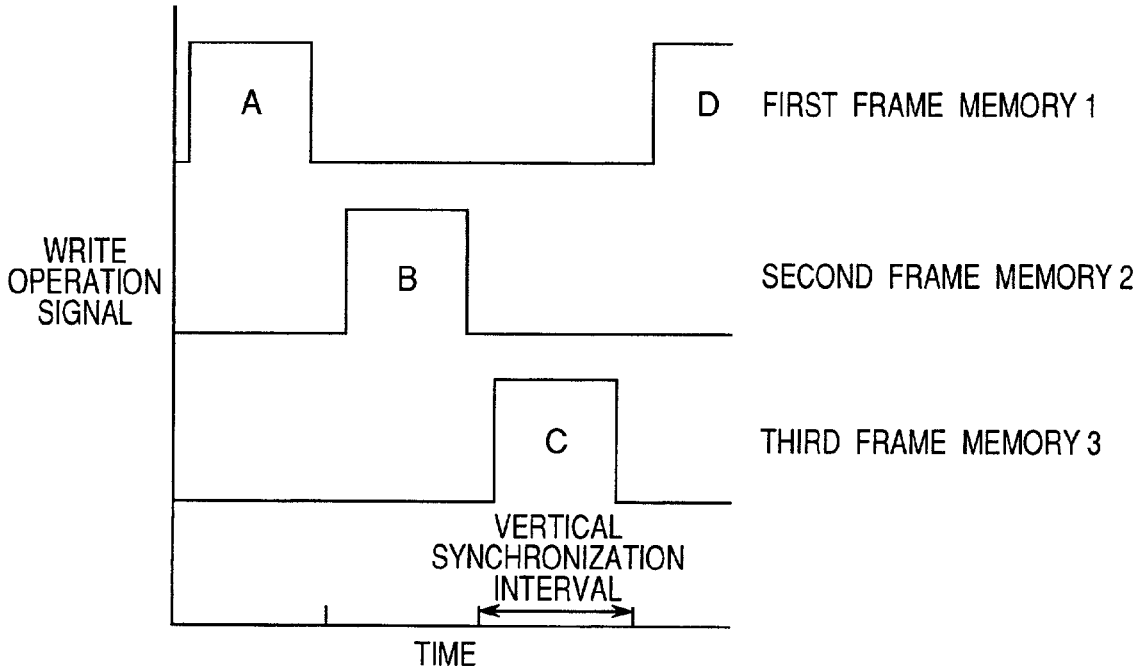
FIG. 2 is a graph showing the write operation signals of the frame memories of FIG. 1.
Figures 3, 4:
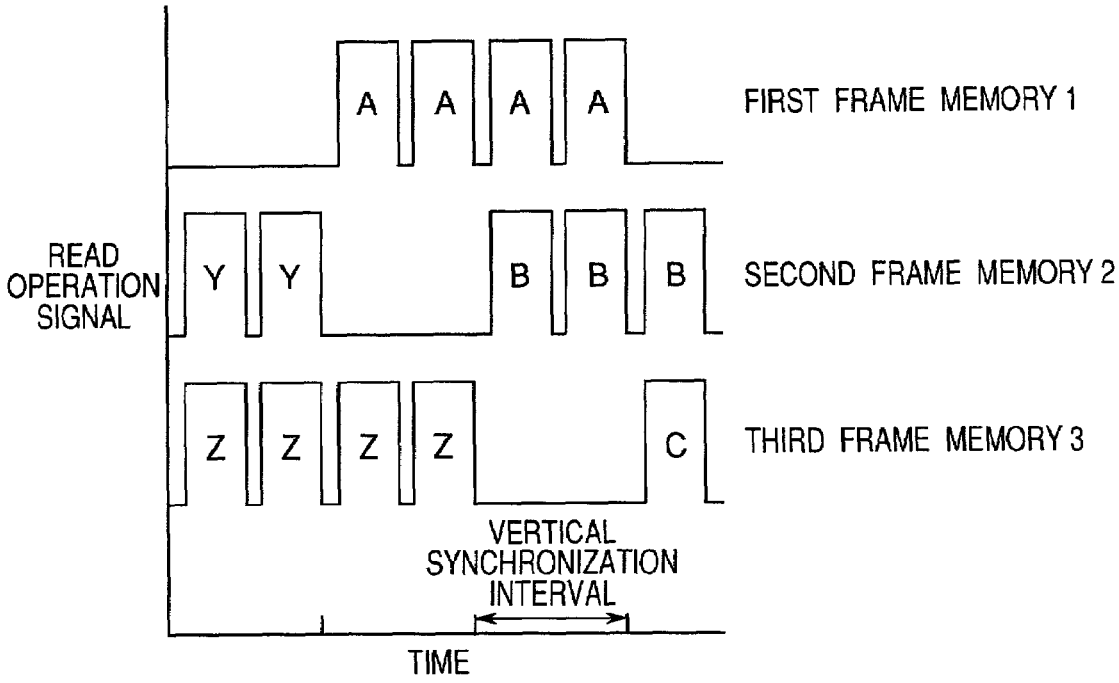
FIG. 3 is a graph showing the read operation signals of the frame memories of FIG. 1.
FIG. 4 is a diagram showing a look-up table of one example.

FIG. 1 is a block diagram of a drive circuit for materializing the liquid crystal display device driving method of the present embodiment. Digital image signals for R, G and B of pixels sequentially read from video equipment or the like are inputted as input image signals to a first frame memory 1, a second frame memory 2 and a third frame memory 3. FIG. 2 shows the write operation signals of the frame memories 1, 2 and 3. FIG. 3 shows the read operation signals of the frame memories 1, 2 and 3. In FIGS. 2 and 3, the reference characters "A", "B", "C", "D", "Y" and "Z" show the image data written in the frame memories 1, 2 and 3.

In the present embodiment, as is apparent from FIGS. 2 and 3, while the image data inputted to any one of the first frame memory 1, the second frame memory 2 and the third frame memory 3 is being written, image data are read repetitively two times in one vertical synchronization interval from the remaining two memories. When one vertical synchronization interval of the inputted image signal thus ends, the first frame memory 1 in which image data A has been written becomes a read frame memory in the next one vertical synchronization interval, and the next image data B is written in the different second frame memory 2. Subsequently, this operation will be sequentially repeated, consistently, with one frame memory used for image data write and with the remaining two frame memories used for image data read. Thus, the two pieces of image data read from the two frame memories are transferred to an arithmetic unit 4.

The arithmetic unit 4, which has a look-up table, refers to the look-up table on the basis of the data values (voltage values) of the image signals inputted from the two frame memories and transfers an image signal constituted of the obtained data value (voltage value) to a liquid crystal display device 5. It is to be noted that the voltage of the data value is applied to the pixel electrode (not shown) of the desired pixel by the image signal thus transferred to the liquid crystal display device 5 although no detailed description is provided. Then, the orientation of the liquid crystal molecules is changed by the applied voltage to change the light transmittance, displaying the pixel.

FIG. 4 shows one example of the look-up table. As for this look-up table, in a position of intersection of the data value of the previous image signal and the data value of the current image signal, a data value of a value greater than the data value of the current image signal is written when the data value of the current image signal is greater than the data value of the previous image signal, a data value of a value smaller than the data value of the current image signal is written when the data value of the current image signal is smaller than the data value of the previous image signal, and the data value of the current image signal is written when the data value of the previous image signal and the data value of the current image signal are equal to each other.

Therefore, upon receiving image data A from the first frame memory 1 and image data Z from the third frame memory 3, the arithmetic unit 4 transfers the data value of the value greater than the data value A of the current image signal to the liquid crystal display device 5 when the data value A of the current image signal is greater than the data value Z of the previous image signal. When the data value A of the current image signal is smaller than the data value Z of the previous image signal, the data value of the value smaller than the data value A of the current image signal is transferred to the liquid crystal display device 5. When the data value Z of the previous image signal and the data value A of the current image signal are equal to each other, the data value A of the current image signal is transferred to the liquid crystal display device 5.

Figure 5:
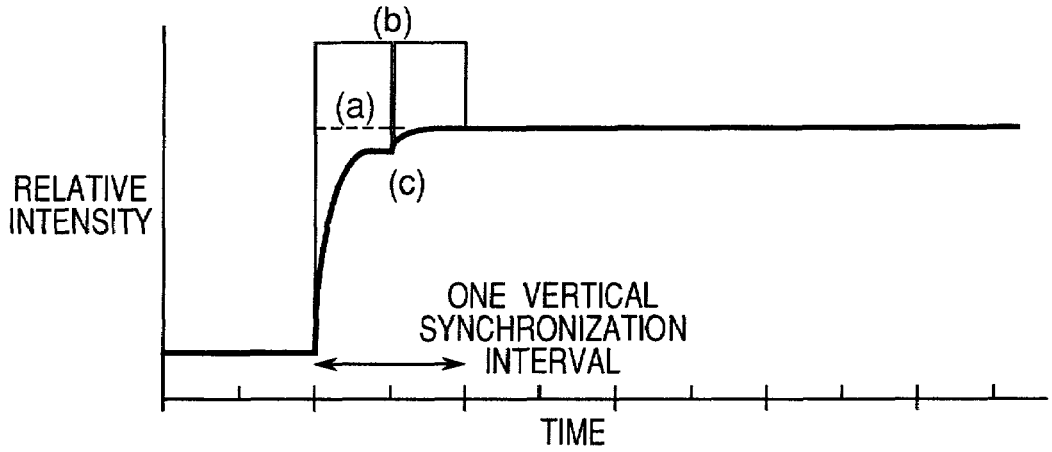
FIG. 5 is a graph showing the data value of an image signal inputted to the liquid crystal display device of FIG. 1 and the change of light transmittance dependent on time.
Figure 6:
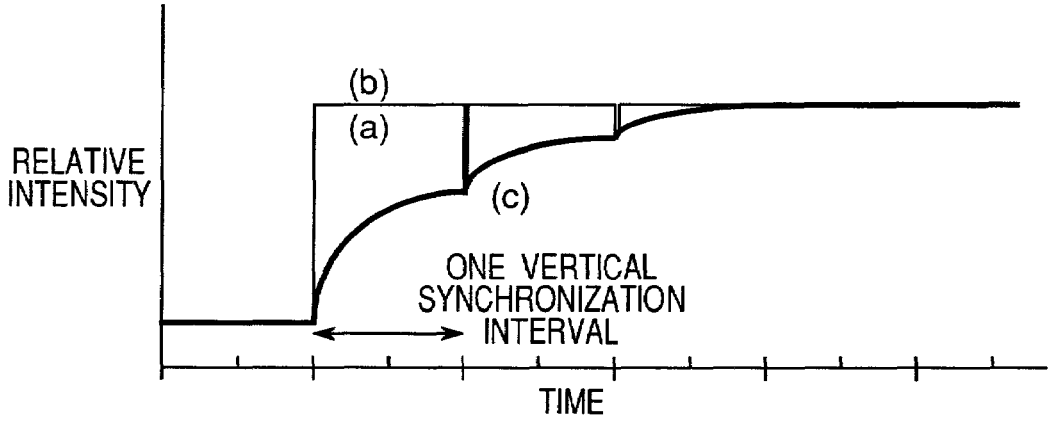
FIG. 6 is a graph showing the data value and the change of light transmittance dependent on time when an identical data value is repetitively inputted three times once per vertical synchronization interval.

FIG. 5 shows the data value (voltage value) of the image signal that is inputted to the liquid crystal display device 5 and applied to the pixel electrode of the desired pixel and the change of light transmittance dependent on time. It is to be noted that the vertical axis represents a relative intensity. In FIG. 5, the reference character (a) represents a (target) data value to be written, the reference character (b) represents the data value inputted from the arithmetic unit 4, and the reference character (c) represents the light transmittance of the display pixel in the liquid crystal display device 5. When the image signal inputted to the arithmetic unit 4 changes from small image data to large image data, as shown in FIG. 5, the data value (b) of the value greater than the data value (a) to be written is inputted to the liquid crystal display device 5 repetitively two times in one vertical synchronization interval. In the above case, it can be understood that the step response of the light transmittance (c) of the display pixel is improved in comparison with the case where the data value (b) of the same value as the target data value (a) is repetitively inputted three times once per vertical synchronization interval, as shown in FIG. 6.

Figure 7:
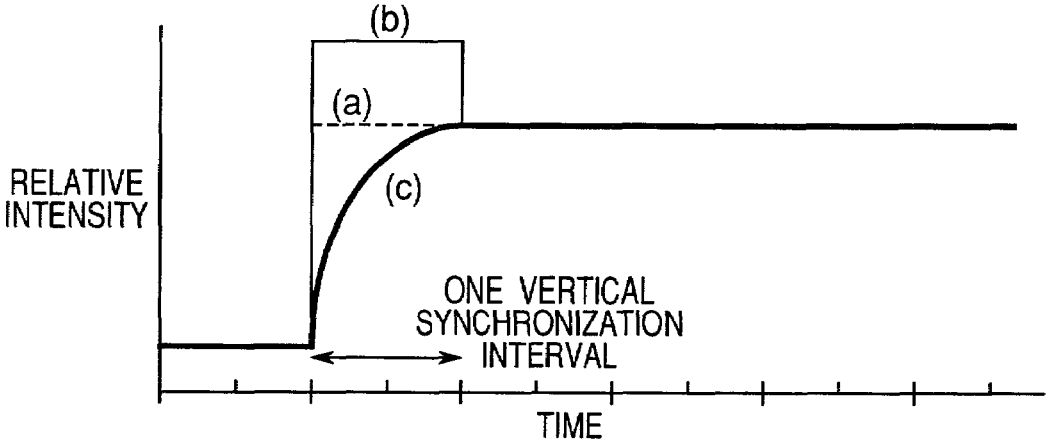
FIG. 7 is a graph showing the data value and the change of light transmittance dependent on time when a data value is inputted once per vertical synchronization interval.

FIG. 7 shows quite the same data values (a) and (b) as those shown in FIG. 5, where the frequency of inputting of the data value (b) is one. In this case, it can be understood that the inclination of the rise of the light transmittance (c) of the display pixel is worse than in the case shown in FIG. 5, and this indicates that the repetitive input of the data value (b) is effective for the improvement of the rise of the light transmittance (c) of the liquid crystal display device 5.

As described above, the present embodiment has the first, second and third frame memories 1, 2 and 3 in which the input image signal is written. While the image data is written into any one of the frame memories, image data are read repetitively two times in one vertical synchronization interval from the remaining two frame memories and transferred to the arithmetic unit 4. This operation is executed with the frame memories sequentially changed. Then, the arithmetic unit 4 refers to the look-up table on the basis of the data values of the image signals inputted from the two input frame memories and transfers to the liquid crystal display device 5, for example, the data value of the value greater than the data value A of the current image signal when the data value A of the current image signal from the first frame memory 1 is greater than the data value Z of the previous image signal from the third frame memory 3, the data value smaller than the data value A when the data value A is smaller than the data value Z and the data value A of the current image signal when the data value A is equal to the data value Z.

Therefore, when the image signal inputted to the arithmetic unit 4 changes from small image data to large image data, as shown in FIG. 5, the data value (b) of the value greater than the target data value (a) is inputted to the liquid crystal display device 5 repetitively two times in one vertical synchronization interval. As a result, the response characteristic of the light transmittance (c) of the liquid crystals is improved in comparison with the case where the data value (b) of the same value as the target data value (a) is repetitively inputted three times once per vertical synchronization interval, as shown in FIG. 6. Moreover, the rise of the light transmittance (c) of the liquid crystals is improved in comparison with the case where the frequency of inputting of the data value (b) is one, as show in FIG. 7.

That is, the present embodiment enables the improvement of the response characteristic of the liquid crystal display device 5, the attainment of the transmittance corresponding to the input image signal in a short period, the achievement of high-speed image display and the improvement of the dynamic image display quality.

Although the read from the frame memories 1, 2 and 3 is executed repetitively two times in one vertical synchronization interval of the image input signal in the aforementioned embodiment, the frequency of repetition is not limited to two. The step response characteristic of the liquid crystal display device 5 is more improved as the frequency of repetition increases, enabling higher-speed image display. However, in the above case, it is required to improve the abilities of the liquid crystal drive elements and the like so that the liquid crystals are charged with electric charges in a short period.

Moreover, in the aforementioned embodiment, the arithmetic unit 4 adopts the look-up table system in which the data value outputted to the liquid crystal display device 5 is obtained by referring to the look-up table on the basis of the two pieces of image data transferred from the two frame memories. However, it is not always required to adopt the look-up table system. According to another method, an arithmetic circuit for executing the operation of, for example, "$A+(A-Z)\times\alpha$" or the like based on the data value A of the current image signal and the data value Z of the previous image signal is mounted on the arithmetic unit. Then, an output from the arithmetic circuit may be outputted as a new image signal to the liquid crystal display device 5.

Second Embodiment

Figure 8:
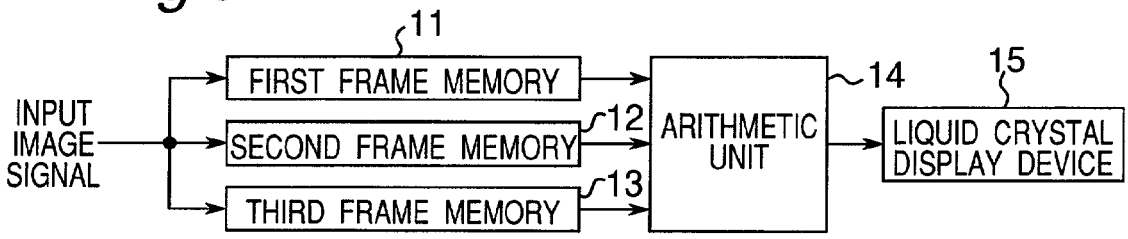
FIG. 8 is a block diagram of a drive circuit different from that of FIG. 1.

FIG. 8 is a block diagram of a drive circuit for materializing the liquid crystal display device driving method of the present embodiment. A first frame memory 11, a second frame memory 12, a third frame memory 13 and a liquid crystal display device 15 have the same constructions as those of the first frame memory 1, the second frame memory 2, the third frame memory 3 and the liquid crystal display device 5, respectively, shown in FIG. 1.

The arithmetic unit 4 of the first embodiment outputs the data value obtained by referring to the look-up table two times out of the data values outputted two times in one vertical synchronization interval. In contrast to this, the arithmetic unit 14 of the present embodiment outputs a data value obtained by referring to the look-up table with regard to a first-time data value out of the data values outputted two times in one vertical synchronization interval, similarly to the first embodiment. However, with regard to a second-time data value, the data value of the current image signal out of the image signals inputted from the two frame memories is outputted.

Figure 9:
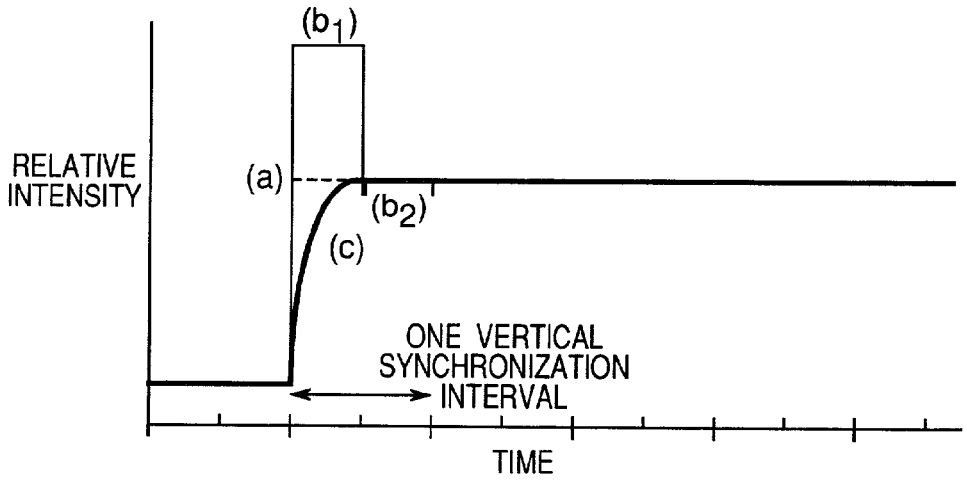
FIG. 9 is a graph showing the data value of an image signal inputted to the liquid crystal display device of FIG. 8 and the change of light transmittance dependent on time.

FIG. 9 shows the data value of the image signal inputted to the liquid crystal display device 15 and the change of light transmittance dependent on time. In FIG. 9, the reference character (a) represents a target data value, the reference character (b) represents a data value inputted from the arithmetic unit 14, and the reference character (c) represents the light transmittance of the display pixel. When the image signal inputted to the arithmetic unit 14 changes from small image data to large image data, as shown in FIG. 9, a data value ($b_1$) of a value greater than the target data value (a) is inputted to the liquid crystal display device 15 once in the first half of one vertical synchronization interval. Next, a data value ($b_2$) of the current image signal, i.e., the target data value (a) is inputted once in the latter half of the same vertical synchronization interval.

In the above case, the response characteristic of the light transmittance (c) can be improved in comparison with the case where the data value (b) of the same value as the target data value (a) is repetitively inputted three times once per vertical synchronization interval, as shown in FIG. 6. Moreover, the rise of the light transmittance (c) can be improved in comparison with the case where the frequency of inputting of the data value (b) is one, as shown in FIG. 7. Furthermore, as shown in FIG. 9, by setting the data value ($b_1$) inputted at a first time to an appropriate value slightly higher than the data value (b) inputted at a first time in the first embodiment shown in FIG. 5, the time for the attainment of the target data value (a) can be made shorter than in the case of the first embodiment.

As described above, in the present embodiment, the arithmetic unit 14 refers to the look-up table on the basis of the data values of the image signals inputted from the two input frame memories and outputs the first-time data value in the first half of one vertical synchronization interval to the liquid crystal display device 15. On the other hand, with regard to the second-time data value in the latter half of the same vertical synchronization interval, the data value of the current image signal out of the data values inputted from the two input frame memories is outputted to the liquid crystal display device 15.

Therefore, by setting the data value ($b_1$) inputted at a first time to an appropriate value slightly higher than the data value (b) inputted at a first time in the first embodiment, the time for the attainment of the target data value (a) can be made shorter than in the case of the first embodiment, and the dynamic image display quality can further be improved.

It is to be noted that the frequency of repetition of read from each of the frame memories 11 through 13 is, of course, not limited to two in the case of the present embodiment, similarly to the case of the first embodiment. The step response characteristic of the liquid crystal display device 15 is more improved as the frequency of repetition increases, enabling higher-speed image display. However, in the above case, it is required to improve the abilities of the liquid crystal drive elements and the like so that the liquid crystals are charged with electric charges in a short period. The operation of the arithmetic unit 14 is not required to conform to the look-up table system. An arithmetic circuit for executing the operation of, for example, "$A+(A-Z)\times\alpha$" or the like based on the data value A of the current image signal and the data value Z of the previous image signal may be mounted on the arithmetic unit.

Figure 10:
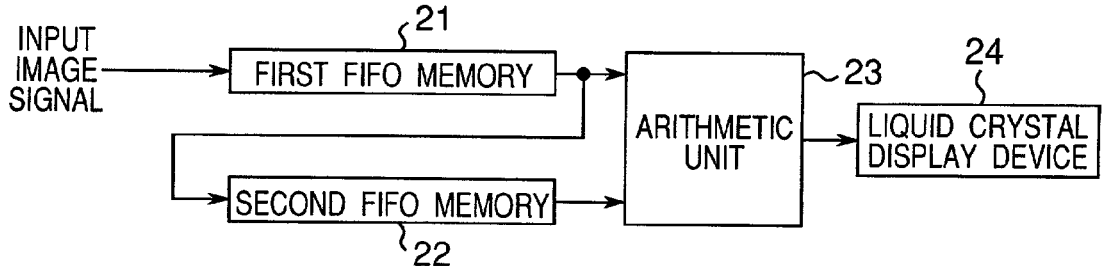
FIG. 10 is a block diagram of a drive circuit different from those of FIGS. 1 and 8.

Furthermore, when the display operation is repeated two times in one vertical synchronization interval, a FIFO (First-In First-Out) memory whose input and output are asynchronous can be employed in place of the first, second and third frame memories 11, 12 and 13 of FIG. 8. In the above case, as shown in FIG. 10, a first FIFO memory 21 and a second FIFO memory 22 are connected in series, and an output from the first FIFO memory 21 and an output from the second FIFO memory 22 are inputted to an arithmetic unit 23. It is to be noted that the arithmetic unit 23 and the liquid crystal display device 24 have the same constructions as those of the arithmetic unit 4 and the liquid crystal display device 5, respectively, of FIG. 1.

Figure 11:
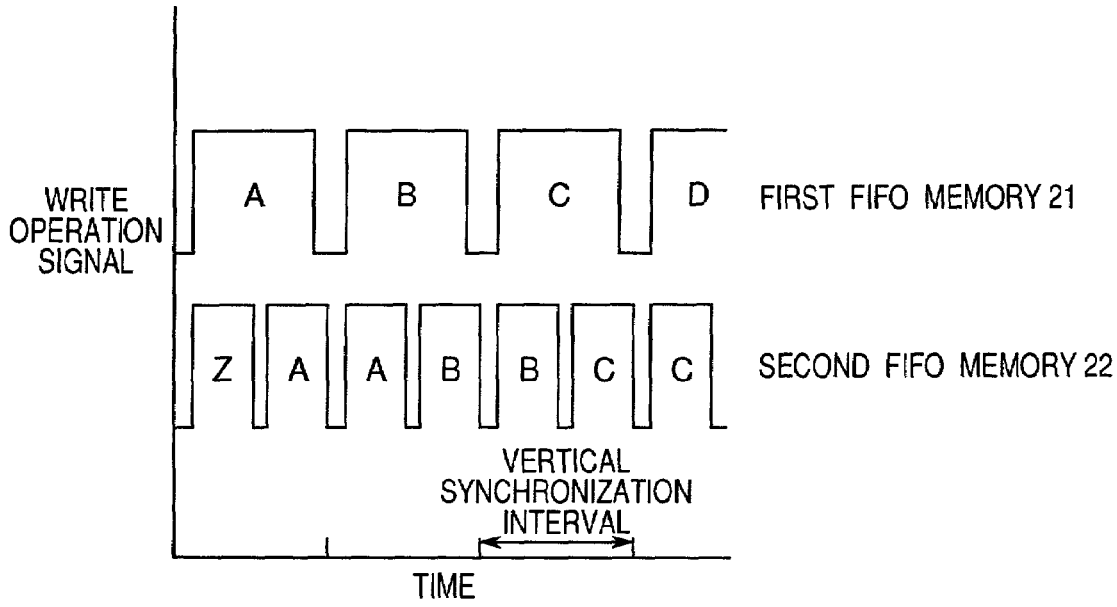
FIG. 11 is a graph showing the write operation signals of the FIFO memories of FIG. 10.
Figure 12:
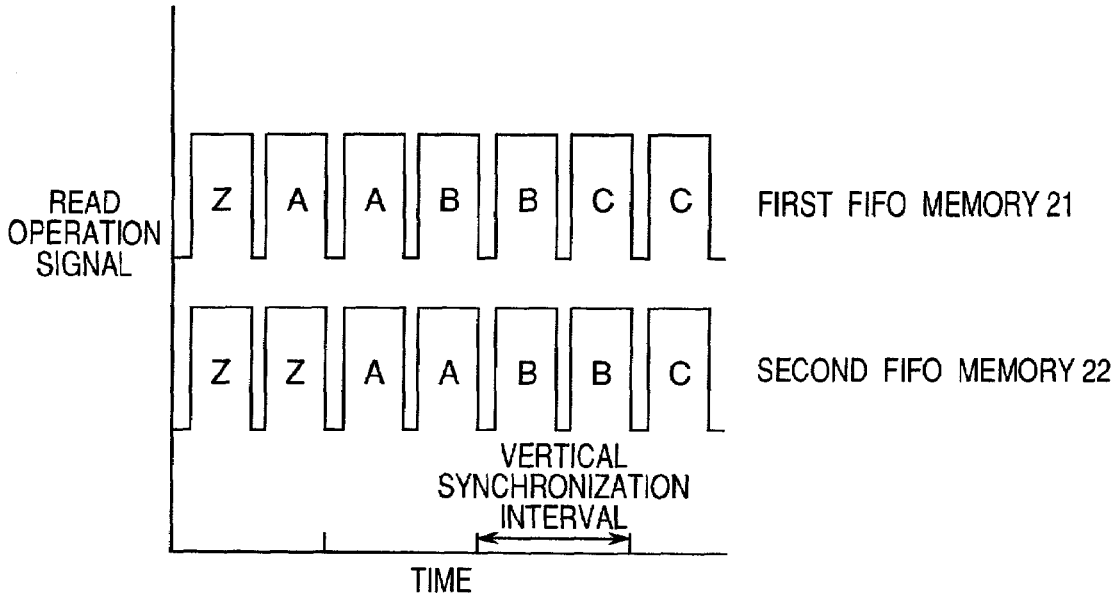
FIG. 12 is a graph showing the read operation signals of the FIFO memories of FIG. 10.

FIG. 11 shows the write operation signals of the FIFO memories 21 and 22. FIG. 12 shows the read operation signals of the FIFO memories 21 and 22. In FIGS. 11 and 12, each of the reference characters "A", "B", "C", "D" and "Z" shows the image data written in the FIFO memories 21 and 22.

As is apparent from FIGS. 11 and 12, the image data are sequentially written in the first FIFO memory 21 every one vertical synchronization interval. Then, image data are read at a speed two times the write speed and transferred to the arithmetic unit 23 and the second FIFO memory 22. Therefore, the write image data of the second FIFO memory 22 in FIG. 11 and the read image data of the first FIFO memory 21 in FIG. 12 are the same. In the second FIFO memory 22, the write and read operations are executed at the same speed (speed twice per vertical synchronization interval) as the read speed of the first FIFO memory 21. As a result, the same image data as the image data outputted from the first FIFO memory 21 is outputted from the second FIFO memory 22 with a delay of one image period.

Therefore, the image data of the same value are inputted to the arithmetic unit 23 alternately from the first FIFO memory 21 and the second FIFO memory 22. As a result, in FIG. 12, the arithmetic unit 23 refers to the look-up table by combining the first-time data value A out of the same data values A and A inputted repetitively two times from the first FIFO memory 21 with the data value Z of the previous image signal and outputs a data value corresponding to the magnitude of the data value A with respect to the data value Z to the liquid crystal display device 24. With regard to the second-time data value A, the look-up table is referred to in combination with the same data value A (data value of the previous image signal), and the data value A of the current image signal is outputted to the liquid crystal display device 24.

That is, according to the construction of FIG. 10, the same display operation as the construction of FIG. 8 can be achieved by the two memories. This arrangement enables the reduction of memory capacity for storing the image, the simplification of the drive circuit and cost reduction.

Third Embodiment

Figure 13:
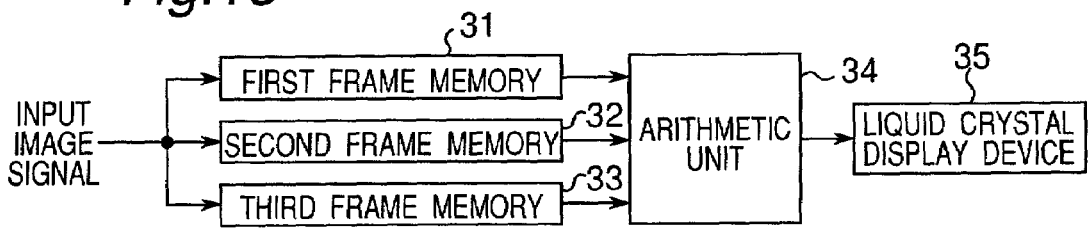
FIG. 13 is a block diagram of a drive circuit different from those of FIGS. 1, 8 and 10.

FIG. 13 is a block diagram of a drive circuit for materializing the liquid crystal display device driving method of the present embodiment. A first frame memory 31, a second frame memory 32, a third frame memory 33 and a liquid crystal display device 35 have the same constructions as those of the first frame memory 1, the second frame memory 2, the third frame memory 3 and the liquid crystal display device 5, respectively, shown in FIG. 1.

The arithmetic unit 4 of the first embodiment outputs the data value obtained by referring to the look-up table two times out of the data values outputted two times in one vertical synchronization interval. In contrast to this, the arithmetic unit 34 of the present embodiment outputs a data value obtained by referring to the look-up table with regard to a first-time data value out of the data values outputted two times in one vertical synchronization interval, similarly to the first embodiment. However, with regard to the second-time data value, a new image signal that has a value intermediate between the values of data inputted from the two frame memories (i.e., a value intermediate between the data value of the current image signal and the data value of the previous image signal) to a liquid crystal display device 35.

Figure 14:
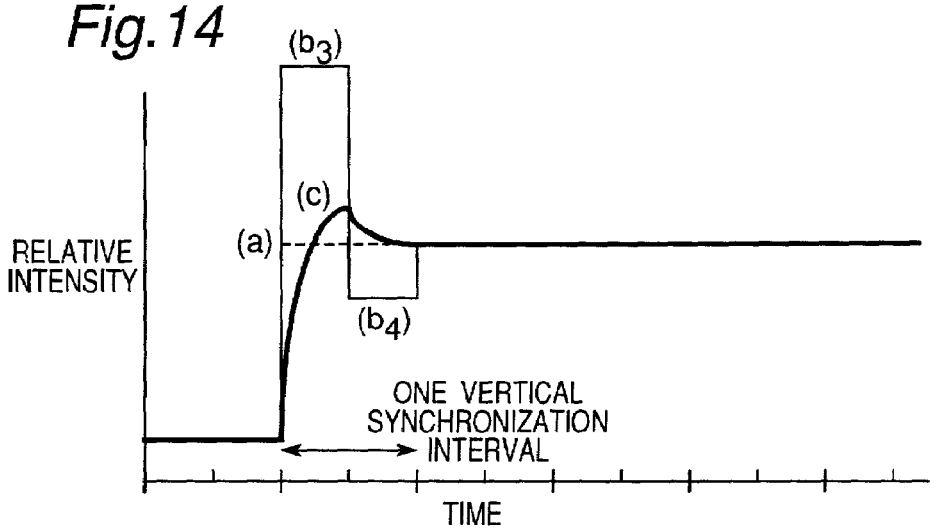
FIG. 14 is a graph showing the data value of an image signal inputted to the liquid crystal display device of FIG. 13 and the change of light transmittance dependent on time.

FIG. 14 shows the data value of the image signal inputted to the liquid crystal display device 35 and the change of light transmittance dependent on time. In FIG. 14, the reference character (a) represents a target data value, the reference character (b) represents a data value inputted from the arithmetic unit 34, and the reference character (c) represents the light transmittance of the display pixel. When the image signal inputted to the arithmetic unit 34 changes from small image data to large image data, as shown in FIG. 14, a data value ($b_3$) of a value greater than the target data value (a) is inputted to the liquid crystal display device 35 once in the first half of one vertical synchronization interval. Next, a data value ($b_4$) of a value, which is smaller than the data value (i.e., the target data value (a)) of the current image signal and is greater than the data value of the previous image signal, is inputted once in the latter half of the same vertical synchronization interval.

In this case, as shown in FIG. 14, the light transmittance (c) of the display pixel, which once becomes greater than the target transmittance, returns to the intended transmittance within one vertical synchronization interval. Therefore, the quantity of light integrated as a result compensates for the insufficient quantity of light at the time of liquid crystal response, and this makes the human sense the same quantity of light as the quantity of light sensed with the intended transmittance in one vertical synchronization interval. Thus, the light transmittance is improved.

Also, in the case of the present embodiment, the step response characteristic of the light transmittance (c) can be improved in comparison with the case where the data value (b) of the same value as the target data value (a) is repetitively inputted three times once per vertical synchronization interval, as shown in FIG. 6. Moreover, the rise of the light transmittance (c) can be improved in comparison with the case where the frequency of inputting of the data value (b) is one, as shown in FIG. 7, and this allows the human to sense the same quantity of light as the quantity of light sensed with the intended transmittance in one vertical synchronization interval.

It is to be noted that the frequency of repetition of read from each of the frame memories 31 through 33 is, of course, not limited to two in the case of the present embodiment, similarly to the case of the first embodiment. The step response characteristic of the liquid crystal display device 35 is more improved as the frequency of repetition increases, enabling higher-speed image display. However, in the above case, it is required to improve the abilities of the liquid crystal drive elements and the like so that the liquid crystals are charged with electric charges in a short period. The operation of the arithmetic unit 34 is not required to conform to the look-up table system. An arithmetic circuit for executing the operation of, for example, "$A+(A-Z)\times\alpha$" or the like based on the data value A of the current image signal and the data value Z of the previous image signal may be mounted on the arithmetic unit.

Fourth Embodiment

Figure 15:
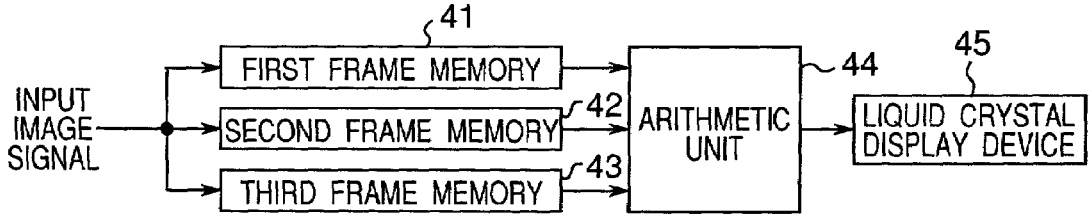
FIG. 15 is a block diagram of a drive circuit different from those of FIGS. 1, 8, 10 and 13.

FIG. 15 is a block diagram of a drive circuit for materializing the liquid crystal display device driving method of the present embodiment. A first frame memory 41, a second frame memory 42, a third frame memory 43 and a liquid crystal display device 45 have the same constructions as those of the first frame memory 1, the second frame memory 2, the third frame memory 3 and the liquid crystal display device 5, respectively, shown in FIG. 1.

The arithmetic unit 34 of the third embodiment outputs the data value obtained by referring to the look-up table with regard to the first-time data out of the data values outputted two times in one vertical synchronization interval and outputs a new image signal, which has a value intermediate between the values of data inputted from the two frame memories (i.e., a value intermediate between the data value of the current image signal and the data value of the previous image signal) to the liquid crystal display device 35 with regard to the second-time data value. In contrast to this, the arithmetic unit 44 of the present embodiment outputs the data value three times in one vertical synchronization interval. Then, with regard to the first-time and second-time data values out of the data values outputted three times, a data value obtained by referring to the look-up table is outputted, similarly to the case of the first embodiment. Then, with regard to the third-time data value, a new image signal that has a value intermediate between the values of data inputted from the two frame memories (i.e., a value intermediate between the data value of the current image signal and the data value of the previous image signal) is outputted to the liquid crystal display device 45.

Figure 16:
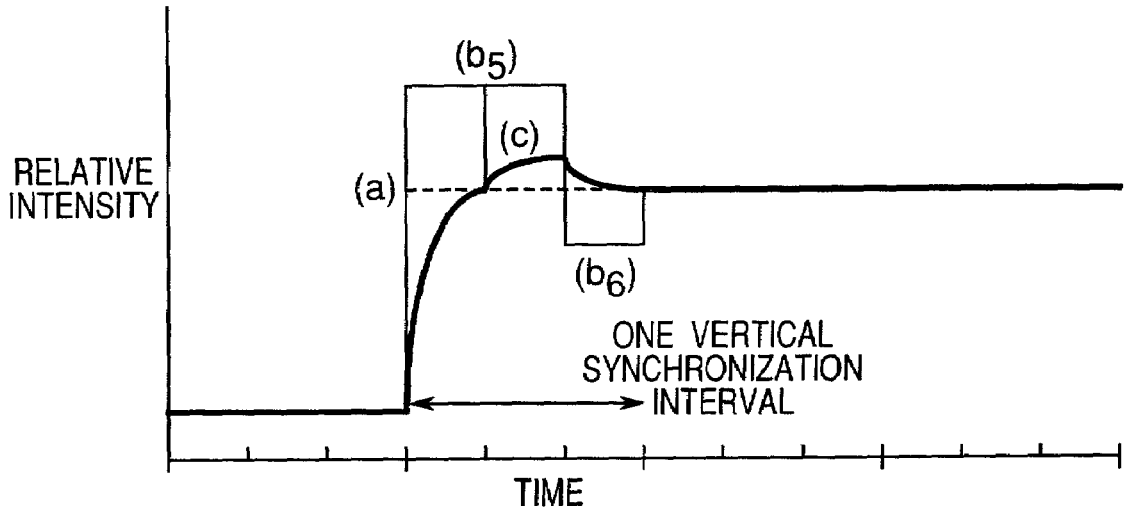
FIG. 16 is a graph showing the data value of an image signal inputted to the liquid crystal display device of FIG. 15 and the change of light transmittance dependent on time.

FIG. 16 shows the data value of the image signal inputted to the liquid crystal display device 45 and the change of light transmittance dependent on time. In FIG. 16, the reference character (a) represents a target data value, the reference character (b) represents a data value inputted from the arithmetic unit 44, and the reference character (c) represents the light transmittance of the display pixel. When the image signal inputted to the arithmetic unit 44 changes from small image data to large image data, as shown in FIG. 16, a data ($b_5$) of a value greater than the target data value (a) is inputted to the liquid crystal display device 45 at first and second times in one vertical synchronization interval divided in three segments. Next, a data value ($b_6$) of a value, which is smaller than the data value (i.e., the target data value (a)) of the current image signal and is greater than the data value of the previous image signal, is inputted once at a third time in the same vertical synchronization interval.

In this case, as shown in FIG. 16, the light transmittance (c) of the display pixel, which once becomes greater than the target transmittance, returns to the target transmittance in one vertical synchronization interval. Therefore, the quantity of light integrated as a result compensates for the insufficient quantity of light at the time of liquid crystal response, and this makes the human sense the same quantity of light as the quantity of light sensed with the intended transmittance in one vertical synchronization interval. Thus, the light transmittance is improved. Moreover, the image data ($b_5$) inputted at first and second times in one vertical synchronization interval can be set to a value smaller than the first-time image data ($b_3$) in one vertical synchronization interval of the third embodiment, and therefore, the liquid crystal drive elements are allowed to have a withstand voltage lower than in the case of the third embodiment.

Also, in the case of the present embodiment, the step response characteristic of the light transmittance (c) can be improved in comparison with the case where the data value (b) of the same value as the target data value (a) is repetitively inputted three times once per vertical synchronization interval, as shown in FIG. 6. Moreover, the rise of the light transmittance (c) can be improved in comparison with the case where the frequency of inputting of the data value (b) is one, as shown in FIG. 7, and this allows the human to sense the same quantity of light as the quantity of light sensed with the intended transmittance in one vertical synchronization interval.

It is to be noted that the operation of the arithmetic unit 44 is not required to conform to the lookup table system also in the case of the present embodiment, similarly to the case of the first embodiment. An arithmetic circuit for executing the operation of, for example, "$A+(A-Z)\times\alpha$" or the like based on the data value A of the current image signal and the data value Z of the previous image signal may be mounted on the arithmetic unit.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display device driving method for driving a liquid crystal display device by supplying image data to be written to pixels of the liquid crystal display device, comprising:

obtaining an image data value on the basis of a data value of an image signal in a previous vertical synchronization interval and a data value of an image signal in a current vertical synchronization interval; and supplying the obtained image data value to at least one pixel at least two times within one vertical synchronization interval, to thereby improve step response characteristics of the liquid crystal display device.

2. A liquid crystal display device driving method as claimed in claim 1, wherein when the data value of the image signal in the current vertical synchronization interval is larger than the data value of the image signal in the previous vertical synchronization interval, image data that has a value larger than the data value of the image signal in the current vertical synchronization interval is supplied at least one of the times.

3. A liquid crystal display device driving method as claimed in claim 1, wherein at least one piece of image data out of the image data supplied at least two times in one vertical synchronization interval has a value smaller than the data value of the image signal in the current vertical synchronization interval.

4. A liquid crystal display device driving method as claimed in claim 1, wherein a transmittance of the each pixel, once in the current vertical synchronization interval, becomes larger than a transmittance corresponding to the data value of the image signal in the current vertical synchronization interval.

5. A liquid crystal display device driven by the driving method as claimed in claim 1, wherein the at least two times is two times.

6. A liquid crystal display device driven by the driving method as claimed in claim 1, wherein the at least two times is three times.

7. A liquid crystal display device driven by the driving method as claimed in claim 1, wherein the driving method is for driving at least one picture electrode of at least one corresponding pixel of a liquid crystal display device by supplying image data to be written to picture electrodes of pixels of the liquid crystal display device.

8. A liquid crystal display device driving method for driving a liquid crystal display device by supplying image data to be written into a pixel of the liquid crystal display device, comprising:

obtaining an image data value to be supplied at least two times within one vertical synchronization interval, to thereby improve step response characteristics of the liquid crystal display device, the image data value being obtained on the basis of a data value of an image signal in a previous vertical synchronization interval and a data value of an image signal in a current vertical synchronization interval.

9. A liquid crystal display device driving method as claimed in claim 8, wherein image data of a data value different from the obtained image data, to be supplied to at least one other time within one vertical synchronization interval, includes image data of a value between the data value of the image signal in the previous vertical synchronization interval and the data value of the image signal in the current vertical synchronization interval.

10. A liquid crystal display device driving method as claimed in claim 8, wherein when the data value of the image signal in the current vertical synchronization interval is larger than the data value of the image signal in the previous vertical synchronization interval, image data that has a value larger than the data value of the image signal in the current vertical synchronization interval is supplied at least one of the times within one vertical synchronization interval.

11. A liquid crystal display device driving method as claimed in claim 8, wherein the image data is supplied to the liquid crystal device three times or more in one vertical synchronization interval.

12. A liquid crystal display device driving method as claimed in claim 8, wherein at least one piece of image data out of the image data supplied the at least two times in one vertical synchronization interval has a value smaller than the data value of the image signal in the current vertical synchronization interval.

13. A liquid crystal display device driving method as claimed in claim 8, wherein a transmittance of the each pixel, once in the current vertical synchronization interval, becomes larger than a transmittance corresponding to the data value of the image signal in the current vertical synchronization interval.

14. A liquid crystal display device driven by the driving method as claimed in claim 8, further comprising a memory that stores data values of image signals in 2 or more vertical synchronization intervals.

15. A liquid crystal display device driven by the driving method as claimed in claim 8, wherein image data of a data value different from the obtained image data value is supplied at least one other of the at least two times in one vertical synchronization interval.

16. A liquid crystal display device driven by the driving method as claimed in claim 15, further comprising a memory that stores data values of image signals in 2 or more vertical synchronization intervals.

17. A liquid crystal display device driving method as claimed in claim 15, wherein the data value different from the determined data value includes image data of a value between the data value of the image signal in the previous vertical synchronization interval and the data value of the image signal in the current vertical synchronization interval.

18. A liquid crystal display device driving method as claimed in claim 15, wherein the data value different from the determined data value includes image data of a value equal to the data value of the image signal in the current vertical synchronization interval.

19. A liquid crystal display device driving method as claimed in claim 18, wherein image data of the determined data value is supplied at least two times in one vertical synchronization interval.

20. A liquid crystal display device driving method as claimed in claim 15, wherein the data value different from the determined data value includes image data of a value less than the data value of the image signal in the current vertical synchronization interval.

21. A liquid crystal display device driving method as claimed in claim 15, wherein image data of the determined data value is supplied at least two times in one vertical synchronization interval.

22. A liquid crystal display device driving method as claimed in claim 21, wherein the data value different from the determined data value includes image data of a value less than the data value of the image signal in the current vertical synchronization interval.

23. A liquid crystal display device driving method as claimed in claim 8, wherein the image data of a data value different from the obtained image data includes image data of a value equal to the data value of the image signal in the current vertical synchronization interval.

24. A liquid crystal display device driving method as claimed in claim 8, wherein the image data of a data value different from the obtained image data includes image data of a value less than the data value of the image signal in the current vertical synchronization interval.

25. A liquid crystal display device driving method as claimed in claim 8, wherein image data of a data value of the obtained image data is supplied at least two times in one vertical synchronization interval.

26. A method for driving at least one pixel of a liquid crystal display device, comprising:

determining a data value of an image signal from a data value of the image signal in a previous vertical synchronization interval and a data value of the image signal in a current vertical synchronization interval; and supplying the determined data value of the image signal to the at least one pixel of the liquid crystal display device at least two times in one vertical synchronization interval, to thereby improve step response characteristics of the liquid crystal display device.

27. The driving method as claimed in claim 26, wherein the driving method is for driving at least one picture electrode of at least one corresponding pixel of a liquid crystal display device by supplying image data to be written to picture electrodes of pixels of the liquid crystal display device.

28. A liquid crystal display device driving method as claimed in claim 27, wherein the image data of a data value different from the obtained image data includes image data of a value less than the data value of the image signal in the current vertical synchronization interval.

29. A liquid crystal display device driving method as claimed in claim 27, wherein image data of a data value of the obtained image data is supplied at least two times in one vertical synchronization interval.

30. A liquid crystal display device driven by the driving method as claimed in claim 26, wherein a data value different from the determined data value is supplied to the at least one picture electrode in at least one other of the at least two times in one vertical synchronization interval.

31. A liquid crystal display device driven by the driving method as claimed in claim 26, wherein a data value the same as the determined data value is supplied to the at least one picture electrode in at least one other of the at least two times in one vertical synchronization interval.

32. An apparatus for driving at least one corresponding pixel of a liquid crystal display device, comprising:

means for determining a data value of an image signal from a data value of the image signal in a previous vertical synchronization interval and a data value of the image signal in a current vertical synchronization interval; and means for supplying the determined data value of the image signal to the at least one pixel of the liquid crystal display device at least two times in one vertical synchronization interval, to thereby improve step response characteristics of the liquid crystal display device.

33. An apparatus as claimed in claim 32, wherein the means for supplying is for supplying at least one picture electrode of at least one corresponding pixel of a liquid crystal display device with image data.

34. An apparatus as claimed in claim 32, wherein a data value different from the determined data value is supplied at least one other of the at least two times.

35. An apparatus as claimed in claim 34, wherein the data value different from the determined data value includes image data of a value between the data value of the image signal in the previous vertical synchronization interval and the data value of the image signal in the current vertical synchronization interval.

36. An apparatus as claimed in claim 34, wherein the data value different from the determined data value includes image data of a value equal to the data value of the image signal in the current vertical synchronization interval.

37. An apparatus as claimed in claim 36, wherein image data of the determined data value is supplied at least two times in one vertical synchronization interval.

38. An apparatus as claimed in claim 34, wherein the data value different from the determined data value includes image data of a value less than the data value of the image signal in the current vertical synchronization interval.

39. An apparatus as claimed in claim 34, wherein image data of the determined data value is supplied at least two times in one vertical synchronization interval.

40. An apparatus as claimed in claim 39, wherein the data value different from the determined data value includes image data of a value less than the data value of the image signal in the current vertical synchronization interval.

41. An apparatus as claimed in claim 32, further comprising:

means for storing the data value of the image signal in a previous vertical synchronization interval and the data value of the image signal in a current vertical synchronization interval.

42. An apparatus for driving at least one pixel of a liquid crystal display device, comprising:

means for storing a data value of an image signal in a previous vertical synchronization interval and a data value of the image signal in a current vertical synchronization interval; and means for supplying a data value of the image signal to the at least one picture electrode of at least one pixel of the liquid crystal display device in each of at least two intervals in one vertical synchronization interval, wherein a data value of the image signal determined from a data value of the image signal in a previous vertical synchronization interval and a data value of the image signal in a current vertical synchronization interval is supplied in each of the at least two intervals, to thereby improve step response characteristics of the liquid crystal display device.

43. An apparatus as claimed in claim 42, wherein the means for supplying is for supplying at least one picture electrode of at least one corresponding pixel of a liquid crystal display device with image data.

44. An apparatus as claimed in claim 42, wherein the means for supplying supplies a data value different from the determined data value in at least one other of the at least two times.

45. An apparatus as claimed in claim 44, wherein the data value different from the determined data value includes image data of a value between the data value of the image signal in the previous vertical synchronization interval and the data value of the image signal in the current vertical synchronization interval.

46. An apparatus as claimed in claim 44, wherein the data value different from the determined data value includes image data of a value equal to the data value of the image signal in the current vertical synchronization interval.

47. An apparatus as claimed in claim 46, wherein image data of the determined data value is supplied at least two times in one vertical synchronization interval.

48. An apparatus as claimed in claim 44, wherein the data value different from the determined data value includes image data of a value less than the data value of the image signal in the current vertical synchronization interval.

49. An apparatus as claimed in claim 44, wherein image data of the determined data value is supplied at least two times in one vertical synchronization interval.

50. An apparatus as claimed in claim 49, wherein the data value different from the determined data value includes image data of a value less than the data value of the image signal in the current vertical synchronization interval.

51. A method for driving at least one pixel of a liquid crystal display device, comprising:

storing a data value of the image signal in a previous vertical synchronization interval and a data value of the image signal in a current vertical synchronization interval; and supplying a data value of the image signal to at least one pixel of the liquid crystal display device in each of at least two intervals in one vertical synchronization interval, wherein a data value of the image signal determined from a data value of the image signal in a previous vertical synchronization interval and a data value of the image signal in a current vertical synchronization interval is supplied to the at least one pixel of the liquid crystal display device at least two times, to thereby improve step response characteristics of the liquid crystal display device.

52. The driving method as claimed in claim 51, wherein the driving method is for driving at least one picture electrode of at least one corresponding pixel of a liquid crystal display device by supplying image data to be written to picture electrodes of pixels of the liquid crystal display device.

53. The driving method as claimed in claim 51, wherein a data value different from the determined data value is supplied at least one other of the at least two times.

54. The driving method as claimed in claim 53, wherein the data value different from the determined data value includes image data of a value between the data value of the image signal in the previous vertical synchronization interval and the data value of the image signal in the current vertical synchronization interval.

55. The driving method as claimed in claim 53, wherein the data value different from the determined data value includes image data of a value equal to the data value of the image signal in the current vertical synchronization interval.

56. The driving method as claimed in claim 55, wherein image data of the determined data value is supplied at least two times in one vertical synchronization interval.

57. The driving method as claimed in claim 53, wherein the data value different from the determined data value includes image data of a value less than the data value of the image signal in the current vertical synchronization interval.

58. The driving method as claimed in claim 53, wherein image data of the determined data value is supplied at least two times in one vertical synchronization interval.

59. The driving method as claimed in claim 58, wherein the data value different from the determined data value includes image data of a value less than the data value of the image signal in the current vertical synchronization interval.

* * * * *